US011548745B2

(12) United States Patent
Honda et al.

(10) Patent No.: US 11,548,745 B2
(45) Date of Patent: Jan. 10, 2023

(54) PLATE SEPARATOR AND PLATE CONVEYANCE SYSTEM

(71) Applicant: FUTABA INDUSTRIAL CO., LTD., Okazaki (JP)

(72) Inventors: Keiji Honda, Okazaki (JP); Kazumi Miake, Okazaki (JP)

(73) Assignee: FUTABA INDUSTRIAL CO., LTD., Okazaki (JP)

( * ) Notice: Subject to any disclaimer, the term of this patent is extended or adjusted under 35 U.S.C. 154(b) by 212 days.

(21) Appl. No.: 17/014,549

(22) Filed: Sep. 8, 2020

(65) Prior Publication Data

US 2021/0094776 A1 Apr. 1, 2021

(30) Foreign Application Priority Data

Sep. 30, 2019 (JP) ..... JP2019-180615

(51) Int. Cl.
*B65H 3/16* (2006.01)
*B65H 3/46* (2006.01)

(52) U.S. Cl.
CPC ..... *B65H 3/16* (2013.01); *B65H 3/46* (2013.01)

(58) Field of Classification Search
CPC ..... B65H 3/16; B65H 2405/1142; B65H 3/46
See application file for complete search history.

(56) References Cited

FOREIGN PATENT DOCUMENTS

| | | | |
|---|---|---|---|
| JP | S59223637 A | | 12/1984 |
| JP | 2009067525 A | * | 4/2009 |
| JP | 2011155136 A | | 8/2011 |
| JP | 2019156585 A | * | 9/2019 |

OTHER PUBLICATIONS

Notice of Reasons for Refusal for Japanese Patent Application No. 2019-180615 dated Sep. 7, 2021, 7 pages including English machine translation.
Notice of Reasons for Refusal for Japanese Patent Application No. 2019-180615 dated Mar. 22, 2022, 8 pages.

* cited by examiner

*Primary Examiner* — Howard J Sanders
(74) *Attorney, Agent, or Firm* — Withrow & Terranova, P.L.L.C.; Vincent K. Gustafson

(57) ABSTRACT

At least one mobile part included in a plate separator is configured movable between a first position and a second position, which is different from the first position. At least one biasing portion biases the at least one mobile part toward the first position. The at least one mobile part includes a contact portion that comes into contact with the top plate when a plate holder lifts the top plate upward. The at least one mobile part is configured to be moved toward the second position as being pushed by the top plate when the top plate in contact with the at least one contact portion is moved further upward, thereby allowing an upward movement of the top plate.

3 Claims, 6 Drawing Sheets

PLATE SEPARATOR AND PLATE CONVEYANCE SYSTEM

CROSS-REFERENCE TO RELATED APPLICATIONS

This application claims the benefit of Japanese Patent Application No. 2019-180615 filed on Sep. 30, 2019 with the Japan Patent Office, the entire disclosure of which is incorporated herein by reference.

BACKGROUND

The present disclosure relates to a plate separator.

For example, in process where a process, such as a press-forming, is performed to a metal plate, there is a case in which a plate situated at a top of a plurality of stacked plates is lifted up using a tool, such as a vacuum cup, in order to convey a plate. Japanese unexamined patent application publication No. S59-223637 discloses a method for separating a plate at the top and the other plates by making a rodding rod or a hooking claw contact with the lifted one or more plates and bending the plate at the top.

SUMMARY

In some cases, separation of the plate at the top and the other plates cannot be achieved with technologies disclosed in the above-described Japanese unexamined patent application publication No. S59-223637, depending on composition, thickness and surface condition of the plate.

One aspect of the present disclosure preferably provides a brand-new device for separating one plate from a plurality of plates.

One aspect of the present disclosure provides a plate separator for separating a plurality of plates stacked along an up-down direction into a top plate, which is situated at a top of the plurality of plates, and lower plate, which is a plate of the plurality of plates other than the top plate, when lifting the top plate upward using a plate holder. The plate separator comprises at least one mobile part and at least one biasing portion. The mobile part is configured movable between a first position and a second position, which is different from the first position. The at least one biasing portion biases the at least one mobile part toward the first position. The at least one mobile part comprises a contact portion that comes into contact with the top plate when the plate holder lifts the top plate upward. The contact portion is disposed on a lower face of the mobile part along a vertical direction. The at least one mobile part is configured to be moved toward the second position as being pushed by the top plate when the top plate in contact with the contact portion is moved further upward, thereby allowing an upward movement of the top plate.

With this configuration, when the plate holder lifts up the top plate, an end of the top plate comes into contact with the contact portion and moves the mobile part toward the second position. After the mobile part is moved to the second position, the top plate can be moved upward. In a process where the top plate is moved upward beside the mobile part, the lower plate stuck below the top plate come into contact with the mobile part, and thus separation of such a lower plate from the top plate is facilitated. That is to say, the above-described plate separator can facilitate the aforementioned separation, based on a brand-new technical idea.

In the above-described plate separator, the at least one mobile part may comprise two or more mobile parts. The two or more mobile parts may be disposed side by side along a direction intersecting with a moving direction of in which the mobile parts are moved from the first position to the second position. In such a configuration, since the plate separator comprises the plurality of mobile parts that facilitate separation of the top plate and the lower plate, separation of the top plate and the lower plates is achieved at a high level.

In the above-described plate separator, the contact portion may comprise a part protruding outward. This configuration allows the outwardly protruding portion of the contact portion to easily contact with the lower plate, and thus can facilitate separation of the top plate and the lower plates at a high level.

The above-described plate separator may further comprise a magnetizing part to magnetize the plurality of plates. In such a configuration, separation of the top plate and the lower plate is achieved at a high level by using both of the magnetizing part and the mobile parts.

Another aspect of the present disclosure provides a plate conveyance system to move a top plate, which is a plate situated at a top of a plurality of plates stacked along an up-down direction. The plate conveyance system comprises: a plate holder; and the at least two plate separators, in one aspect of the present disclosure as described above. The plate holder lifts the top plate upward to move the top plate to a specified position. The at least two plate separators comprise a first plate separator and a second plate separator disposed on both sides of the top plate. A space between the at least one mobile part in the first plate separator and the at least one mobile part in the second plate separator is smaller than a width of the top plate.

Such a system allows the plate separator according to the above-described aspect to exhibit its performance. Moreover, as the plate holder lifts up the top plate, the top plate and the lower plate come into contact with at least either one of the mobile parts, and thus separation of them is favorably achieved.

BRIEF DESCRIPTION OF THE DRAWINGS

An example embodiment of the present disclosure will be described hereinafter by way of example with reference to the accompanying drawings, in which.

DETAILED DESCRIPTION OF EXEMPLARY EMBODIMENTS

1. Embodiment

[1-1. Configuration of Plate Conveyance System]

Figure 1A:
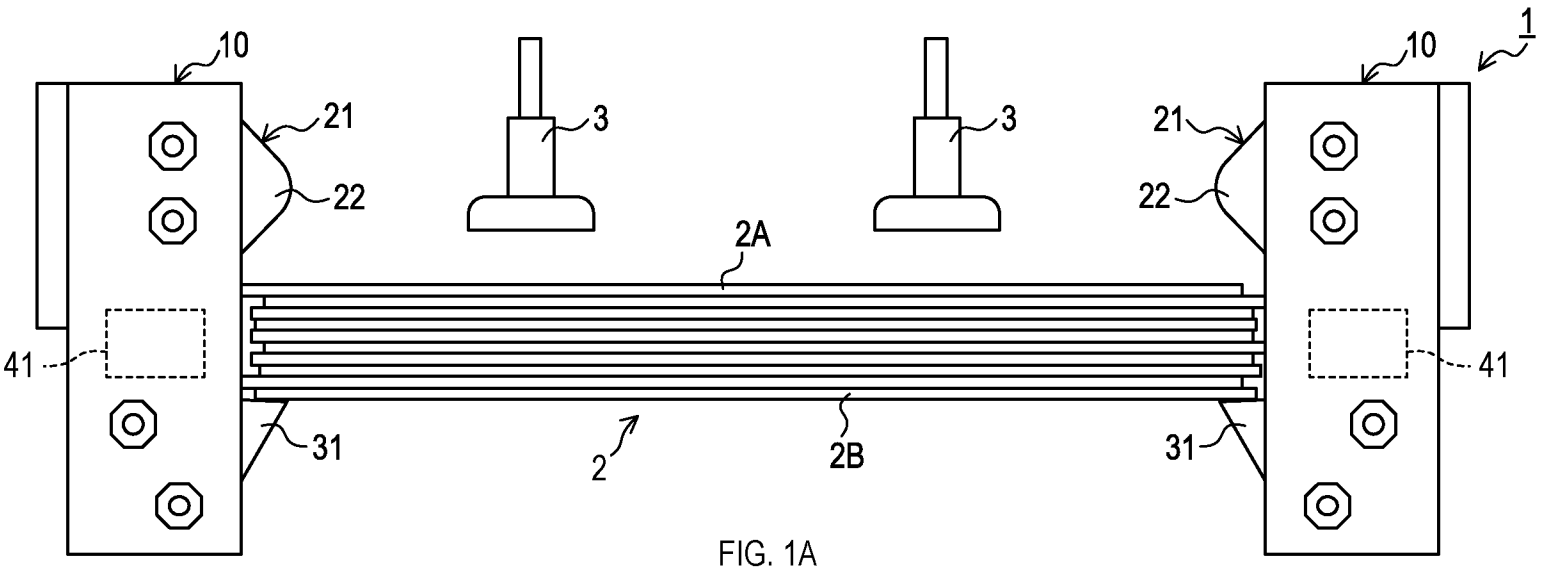
FIG. 1A is a schematic front view showing a plate conveyance system according to an embodiment.
Figure 1B:
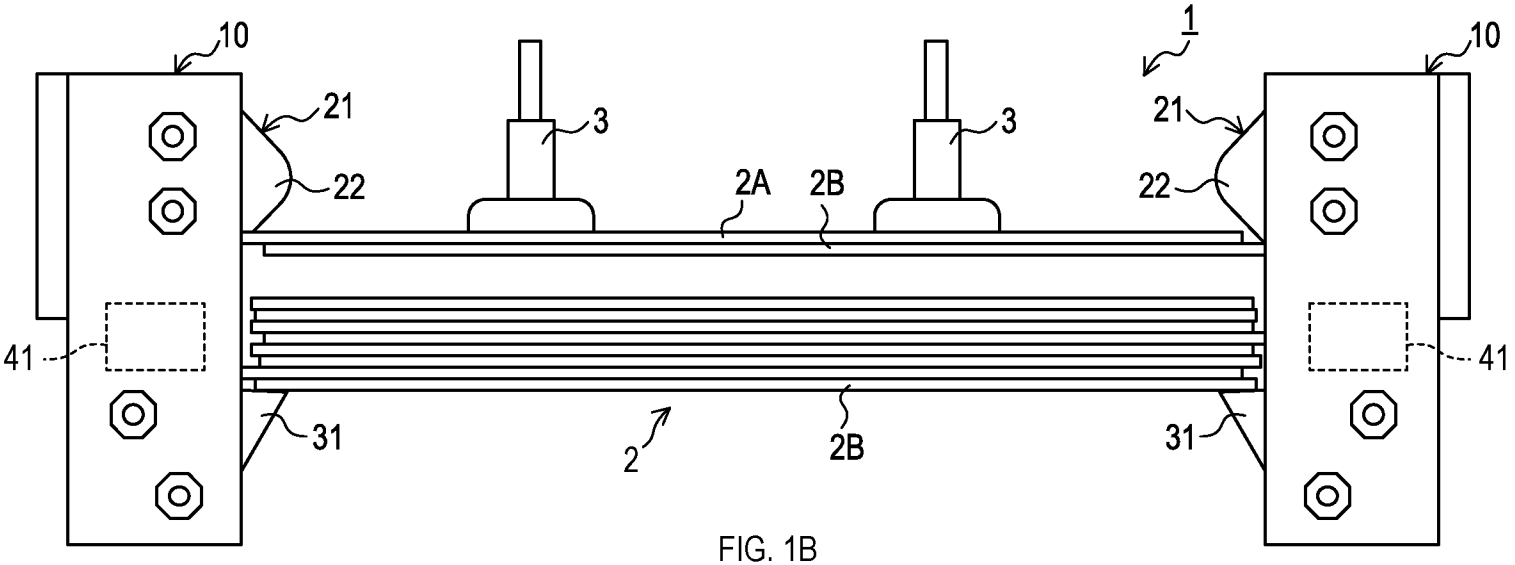
FIG. 1B is a schematic front view showing the plate conveyance system when a plate holder holds a top plate 2A.

A plate conveyance system 1 shown in FIGS. 1A and 1B is a system configured to lift up a top plate 2A, which is situated at a top of a plurality of plates 2 stacked along an up-down direction, and to convey the top plate 2A to a specified position.

The plate conveyance system 1 comprises one or more plate holders 3 and one or more plate separators 10. Although the present embodiment exemplifies a configuration in which two plate holders 3 and two plate separators 10 are used, the number and layout of the plate holders 3 and the plate separator 10 may be arbitrarily set according to size, shape and the like of the plate 2.

The plate holders 3 are configured movable along an up-down direction and a horizontal direction within a specified area. As shown in FIG. 1B, the plate holders 3 are moved downward and come into contact with an upper surface of the top plate 2A, thereby holding the top plate 2A and lifting the top plate 2A upward. A vacuum cup, for example, may be used as the plate holders 3, to hold the upper surface of the top plate 2A by a vacuum chucking. Besides the vacuum cup, as a matter of course, a device capable of holding the plate may be used. For example, the plate holders 3 may use magnets, adhesive material or such to hold the upper surface of the top plate 2A. The plate holders 3 may be configured to hold the top plate 2A by pinching lateral surfaces of the top plate 2A, which are positioned on opposite sides to each other. The plate holders 3 may be configured to hold the top plate 2A by each having a locking component, such as a hook, lock with a locking piece formed at each end of the top plate 2A.

Figure 2C:
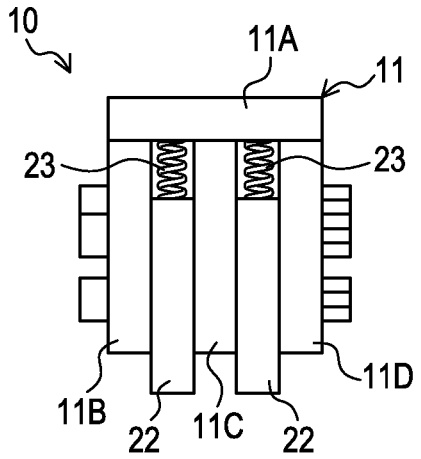
FIG. 2C is a plane view of the plate separator according to the embodiment.
Figure 2A:
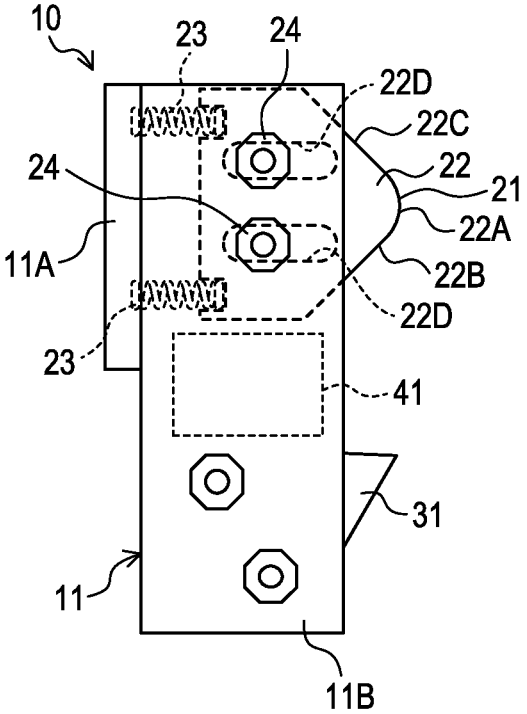
FIG. 2A is a left side view of a plate separator according to the embodiment.
Figure 2B:
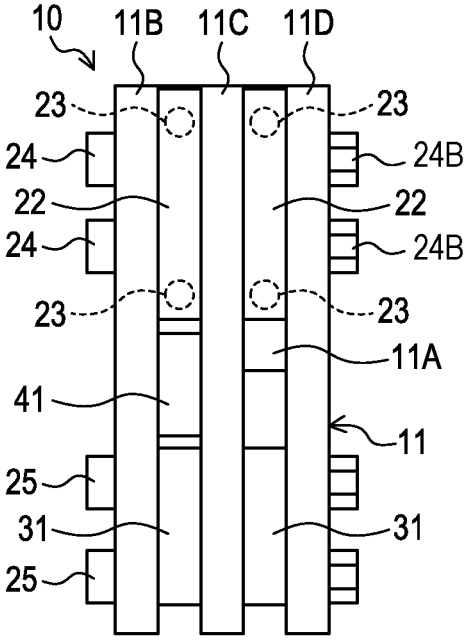
FIG. 2B is a front view of the plate separator according to the embodiment.

The plate separator 10, as shown in FIGS. 2A to 2C, comprises: a housing 11; a movable unit 21; a receiving plate 31; and a magnetizing part 41. The plate separator 10 is configured to separate the top plate 2A from a lower plate 2B, when lifting the top plate 2A upward using the plate holders 3.

The housing 11 supports the movable unit 21, the receiving plate 31, and the magnetizing part 41. The housing 11 comprises: a base plate 11A; and guide plates 11B to 11D. The base plate 11A is a plate-shaped member. The guide plates 11B to 11D are disposed in such a manner that the plates are stacked with spaces between one another, and fixed to the base plate 11A such that the guide plates are perpendicular to the base plate 11A.

The movable unit 21 comprises: two latch plates 22; four springs 23; and two bolts 24. Each of the latch plates 22 is an example of a mobile part, and the spring 23 is an example of a biasing portion.

Figure 3C:
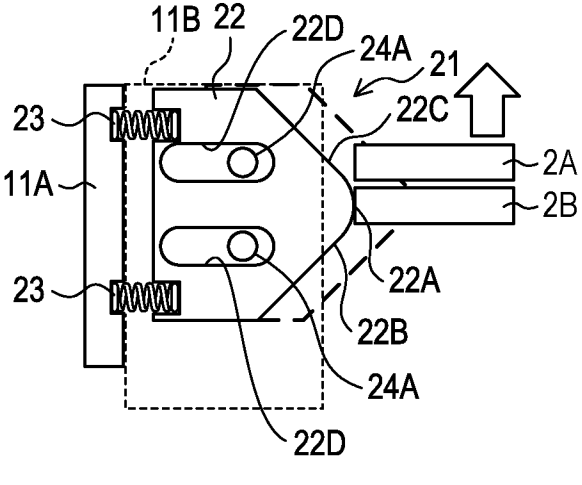
FIGS. 3A to 3C are schematic side views illustrating motion of a movable unit.
Figure 3B:
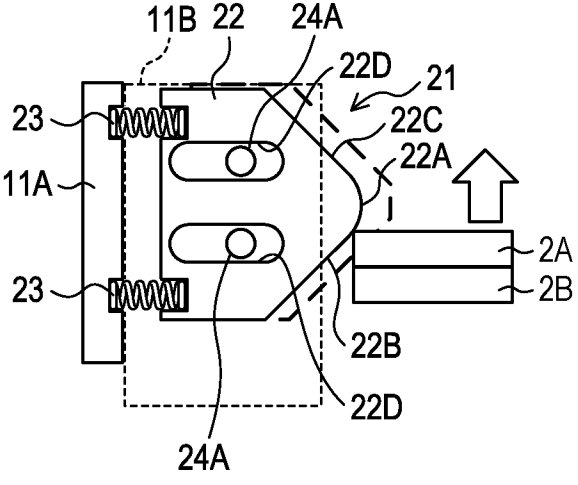
Figure 3A:
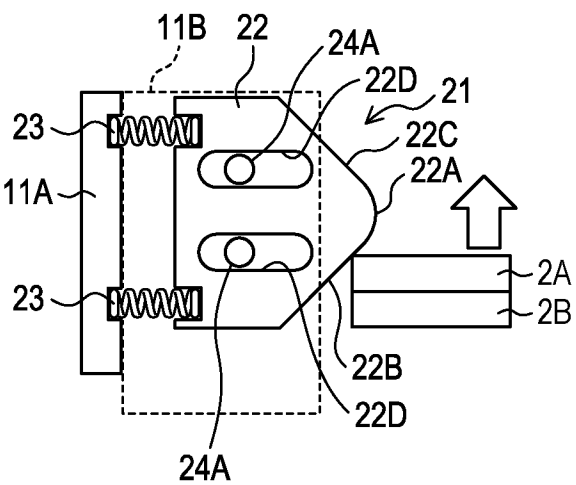

The latch plates 22 are plate-shaped members each disposed between the guide plate 11B and the guide plate 11C, and between the guide plate 11C and the guide plate 11D. Each of the latch plates 22 is configured movable between a first position and a second position, which is different from the first position. The first position, as shown in FIG. 3A, is a position in which a space between the latch plate 22 and the base plate 11A is relatively large, and a part of the latch plate 22 protruding beyond the guide plate 11B is large. Meanwhile, the second position, as shown in FIG. 3C, is a position in which a space between the latch plate 22 and the base plate 11A is relatively small, and a part of the latch plate 22 protruding beyond the guide plate 11B is small. The two latch plates 22 are disposed side by side along a direction intersecting with a moving direction in which the latch plates are moved from the first position to the second position. What is meant by the moving direction here is a direction along which a straight line that joins a position of a designated portion of the latch plate 22 (for example, a later-described tip portion 22A) when the latch plate 22 is at the first position and a position of the designated portion of the latch plate 22 when the latch plate 22 is at the second position extends. The two latch plates 22, in other words, are disposed along a plate thickness direction. In the present embodiment, the intersecting direction is a direction substantially perpendicular to the moving direction.

The two latch plates 22 are identical in shape. Each of the latch plates 22 comprises: a tip portion 22A located at a tip in a protruding direction of the latch plate beyond the guide plate 11B; a lower side inclined face 22B located below the tip portion 22A; an upper side inclined face 22C located above the tip portion 22A; and two slots 22D. The above-described protruding direction is a same direction as a direction that the later-described spring 23 biases the latch plate 22. Hereinafter, the direction will be described as a biasing direction.

The lower side inclined face 22B is a face that comes into contact with the top plate 2A when the top plate 2A is lifted up by the plate holders 3.

The lower side inclined face 22B is located on a lower face of the latch plate 22 along a vertical direction. The lower side inclined face 22B inclines upward more toward a center of the plate 2. In other words, the lower side inclined face 22B is configured in such a manner that it is formed at a part situated on the lower face of the latch plate 22 and it is located upper as being closer to the aforementioned tip portion 22A when the latch plate 22 is at the first position. The tip portion 22A is provided on a tip of the latch plate 22 in the biasing direction. The tip, in other words, is a tip of the latch plate 22 in a direction from the plate separator 10 toward the plate 2. The lower side inclined face 22B, in yet other words, is a face configured to be located lower toward an opposite side of the end side of the latch plate 22 along its horizontal direction, among faces of the latch plate 22 facing down when the latch plate 22 is at the first position. The lower side inclined face 22B corresponds to the contact portion. Because of the above-described configuration, the lower side inclined face 22B can be described as a slope, as well. In the lower side inclined face 22B, a nearby portion of the tip portion 22A, as shown in FIG. 4B, comprises a protruding portion 22E having a curved shape in a side view and protruding outwardly.

The upper side inclined face 22C is a face configured to be located upward toward the opposite side of the end side of the latch plate 22 along its horizontal direction among faces of the latch plate 22 facing up when the latch plate 22 is at the first position.

The two slots 22D are through holes, each having a length extending in the biasing direction. The two slots 22D are disposed side by side along a direction intersecting with longitudinal directions of the slots. As shown in FIGS. 3A to 3C, axes 24A of the two bolts 24, each pass through inside of an individual slot 22D. With this configuration, a movement range of the latch plate 22 and an orientation of the latch plate 22 are determined.

The spring 23 is a coil spring. The spring 23 is configured to come into contact at one end with the base plate 11A and come into contact at another end with the latch plate 22. The spring 23 accordingly biases the latch plate 22 in a direction away from the base plate 11A. That is to say, the spring 23 biases the latch plate 22 toward the first position.

The bolt 24 is fixed to the housing 11 in such a manner that the bolt penetrates from the guide plate 11B through the guide plate 11D. A nut 24B is fastened into thread of the bolt 24. The axis 24A of the bolt 24, as previously described, passes through the slot 22D.

The receiving plate 31, as shown in FIGS. 1A and 1B, is configured to support the plurality of plates 2 from below. The receiving plate 31 is fixed to the housing 11, and at least at a part of the plate 31 protrudes beyond the housing 11. An upper surface of the protruded part has a plane shape so that an end of a plate 2, which is situated at the lowermost of the plurality of plates 2 can be placed thereon.

The magnetizing part 41 is a so-called magnetic floater and provided in the housing 11. The magnetizing part 41 comprises, for example, a permanent magnet or an electromagnet. The plurality of plates 2 disposed on a side of the magnetizing part 41 are magnetized by the magnetizing part 41. The plurality of magnetized plates 2 are repulsive to one another and thus easily separate from one another. A specific configuration and arrangement of the magnetizing part 41 are not especially limited, and may be modified in various forms in which the plurality of plates 2 are magnetized.

[1-2. Motion of Movable Unit]

Hereinafter, a description will be given of a case where the lower plate 2B stuck to the top plate 2A is lifted up together when the plate holders 3 hold the top plate 2A. A force by which the top plate 2A and the lower plate 2B stick to each other is generated due to an oil for rust prevention adhered on the plate surfaces or a vacuum created between the plates during a vacuuming. As a result, the lower plate 2B could be stuck below the top plate 2A.

In the plate conveyance system 1 according to the present embodiment, as shown in FIGS. 1A and 1B, the two plate separators 10 are disposed on both sides of the top plate 2A as a center. A space between tip portions 22A of a pair of the latch plates 22 at the above-described the first position is smaller than a width of the top plate 2A. What is meant by the width here is a width of a part of the top plate 2A situated between the two plate separators 10.

With reference to FIGS. 3A to 3C, a description will be given of how the movable unit 21 of the plate separators 10 moves. When the latch plate 22 is subjected to a load only from the spring 23, the latch plate 22 is located at a position shown in FIG. 3A, namely, the first position.

As the plate holders 3 raise the top plate 2A, the end of the top plate 2A comes into contact with the lower side inclined face 22B of the latch plate 22 at the first position. As the top plate 2A is raised further, the top plate 2A is moved upward while sliding on the surface of the latch plate 22. The latch plate 22 is pushed by the top plate 2A at that time. A biasing force from the spring 23 is smaller than a force applied to the latch plate 22 in a direction opposite to the biasing direction in response to sliding of the raised top plate on the lower side inclined face 22B. Thus, as shown in FIG. 3B, the latch plate 22 is moved toward the above-described second position.

When the top plate 2A is in contact with the tip portion 22A in response to a further raise of the top plate 2A, the latch plate 22 is pushed into the innermost and is moved to the second position. The latch plate 22 is moved to the inner side in such a manner, thereby the top plate 2A is movable in a direction upper than the latch plate 22, When the lower plate 2B is situated below the top plate 2A as shown in FIG. 3C, the latch plate 22 acts on the lower plate 2B to facilitate separation of the top plate 2A and the lower plate 2B.

Figure 4A:
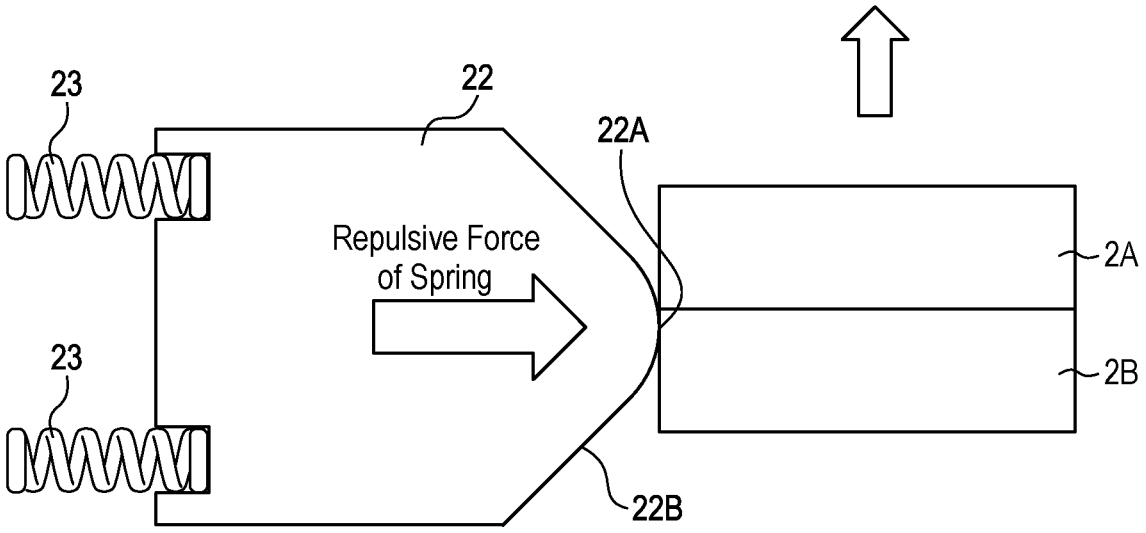
FIGS. 4A and 4B are schematic side views illustrating how a mobile part separates the top plate and the lower plates.
Figure 4B:
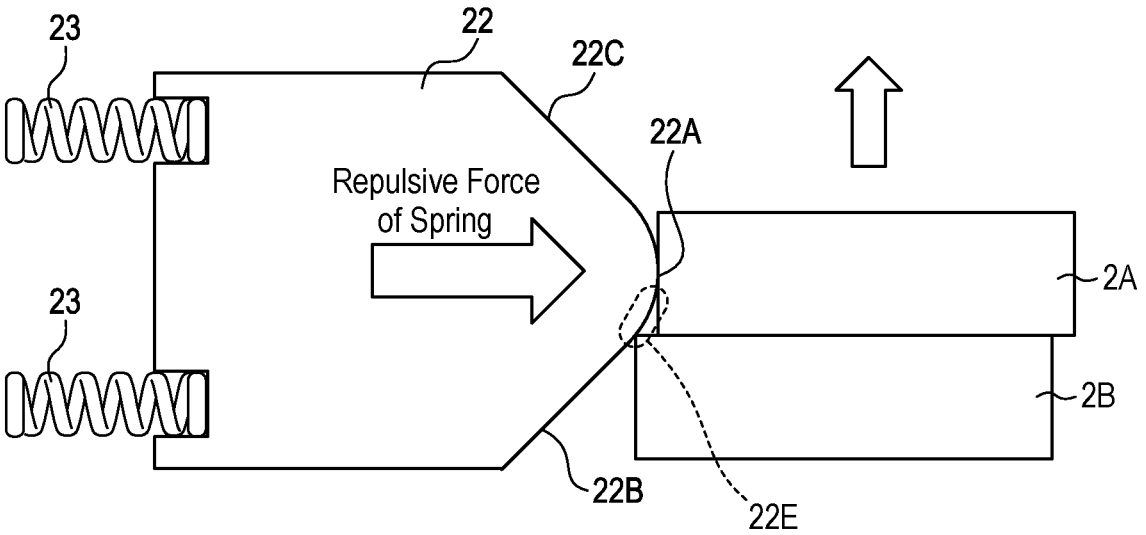

FIG. 4A shows a case where the top plate 2A and the plate 2B are stacked without having any horizontal deviation. After the top plate 2A is moved upward and passes through the tip portion 22A, the tip portion 22A and the lower plate 2B come into contact with each other. Then the biasing force from the spring 23 is applied to the lower plate 2B, and a friction force is generated between the tip portion 22A and the lower plate 2B. A force is accordingly applied to the lower plate 2B in a vertical downward direction. In such a configuration, the load applied to the lower plate 2B in the vertical downward direction is larger than a force that causes the lower plate 2B and the top plate 2A stick together, and thus separation of the top plate 2A and the lower plate 2B is facilitated.

FIG. 4B shows a case where the stacked top plate 2A and lower plates 2B horizontally deviate. As FIG. 4B shows, when the lower plates 2B is situated closer to the latch plate 22 than the top plate 2A is, the lower plate 2B is in contact with the lower side inclined face 22B. The lower plate 2B thus receives a downward load from the latch plate 22. In such a configuration, the force applied to the lower plate 2B in the vertical downward direction is larger than a force that causes the lower plate 2B and the top plate 2A stick together, and thus separation of the top plate 2A and the lower plate 2B is facilitated. The protruding portion 22E helps the latch plate 22 and the lower plate 2B easily come into contact with one another.

Meanwhile, a description will be given of a motion of a latch plate 22 that is not shown in the drawings but disposed on an opposite side of the latch plate 22 shown in FIG. 4B with the top plate 2A interposed therebetween. On the opposite side, the top plate 2A is situated closer to the latch plate 22 than the lower plate 2B is. In such a configuration, the latch plate 22 cannot push the lower plate 2B downward from above as shown in FIG. 4B, however, may push the lower plate 2B in the horizontal direction as shown FIG. 4A to facilitate separation of the top plate 2A and the lower plate 2B.

Even when the plate holders 3 lift up only the top plate 2A, the motion of the movable unit 21 does not greatly vary from a case where the lower plate 2B is stuck to the top plate 2A from below.

[1-3. Effects]

According to the above-detailed embodiment, the following effects can be obtained.

(1a) In the plate separator 10, when the plate holders 3 lift up the top plate 2A, the end of the top plate 2A comes into contact with the lower side inclined face 22B, and pushes the latch plate 22 to the second position. In a process where the top plate 2A passes by the latch plate 22, the lower plate 2B is pushed by the tip portion 22A or the lower side inclined face 22B. With this configuration, separation of the top plate 2A and the lower plate 2B is facilitated. After the latch plate 22 is moved to the second position, the top plate 2A is movable upwardly. Such a configuration reduces a risk of fallout of the top plate 2A from the plate holders 3, and thus the top plate 2A can be conveyed to a desired position more certainly with the plate holders 3.

(1b) The plate separator 10 comprises the two latch plates 22. Each of the latch plates 22 performs a separation of the top plate 2A and the lower plates 2B. Thus, separation of the top plate 2A and the lower plates 2B can be achieved at a high level with a single plate separator 10.

(1c) The protruding portion 22E provided near the tip portion 22A of the lower side inclined face 22B of the latch plate 22 has a curved shape protruding outwardly. In such a configuration, when the top plate 2A and the lower plate 2B deviate from one another, as shown in FIG. 4B, the lower side inclined face 22B more easily comes into contact with the lower plate 2B. Thus, separation of the top plate 2A and the lower plate 2B is suitably achieved.

(1d) The plate separator 10 comprises the magnetizing part 41. With this configuration, separation of the top plate 2A and the lower plate 2B using the movable unit 21 is more certainly achieved.

(1e) In the plate conveyance system 1, the space between the tip portions 22A of the two latch plates 22 facing each other is smaller than the width of the top plate 2A when both of the two latch plates 22 are at the first position. In such a configuration, when the plate holders 3 raise the top plate 2A, the top plate 2A and the lower plate 2B come into contact with at least either one of the latch plates 22. As a result, separation of the top plate 2A and the lower plate 2B is suitably separated.

Figure 5:
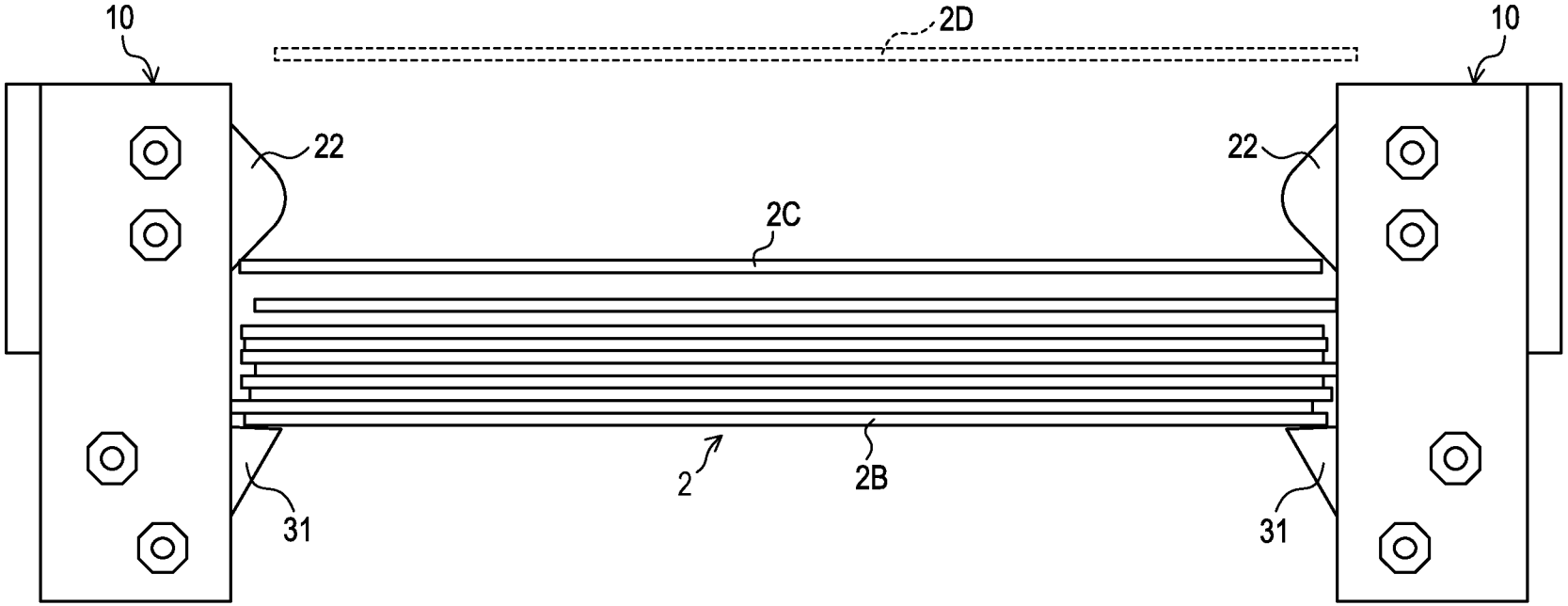
FIG. 5 is a front view illustrating one of performances of the plate conveyance system.

(1f) Since the plate separator 10 comprises the magnetizing part 41, the plates 2 are separated from one another by magnetic force, and the top plate 2A is accordingly moved upward due to the magnetic force. As shown in FIG. 5, the latch plate 22 is configured to come into contact with the plate 2C raised due to the magnetic force, thereby inhibiting a plate from jumping out to an unexpected position due to magnetic force in a manner as indicated by the plate 2D with a dashed line.

In a case where the plate separator 10 comprises the magnetizing part 41 as described in the present embodiment, the latch plate 22 may be disposed so as to be positioned on an upper side than a position where the top plate 2A floats because of magnetization. With this configuration, movement of the top plate 2A and the lower plate 2B in a direction upper than the latch plate 22 due to magnetic force can be restricted, and separating performance of the movable unit 21 is sufficiently exerted.

2. Other Embodiments

The embodiment of the present disclosure has been described. However, the present disclosure should not be limited by the aforementioned embodiment, and can be practiced in various manners.

(2a) The aforementioned embodiment exemplifies the latch plate 22 as one example of the mobile part comprising a contact portion. However, the mobile part is not limited to a form of the latch plate 22. The latch plate may be at least configured to comprise a contact portion located on the lower side of the latch plate along the vertical direction, and contacting with the top plate 2A when the plate holders 3 lift the top plate 2A upward. The contact portion having such a configuration may be a slope formed on the lower side portion of the latch plate and having an end located upper toward the top plate side when the latch plate is at the first position. The latch plate may be, for example, configured not to comprise the upper side inclined face 22C or the protruding portion 22E, and a lower end part of the lower side inclined face 22B, that is, a the part that comes into contact with the top plate 2A, may have a sharp end.

(2b) Although the aforementioned embodiment exemplifies the spring 23, which is a coil spring, as one example of the biasing portion, a member other than the spring 23 may be used as the biasing portion. For example, an elastic members such as a plate spring, a torsion bar, or an elastomer may be used. The number and arrangement of springs and such used as the biasing portion are not especially limited.

(2c) The aforementioned embodiment exemplifies a configuration in which the latch plate 22 slidably moves along the horizontal direction within the specified area using the axis 24A and the slot 22D. However, the configuration to achieve the movement of the latch plate 22 is not limited to the above-described configuration. For example, the latch plate 22 may be configured to be movable within a specified area with a slide structure with the use of a rail.

Figure 6:
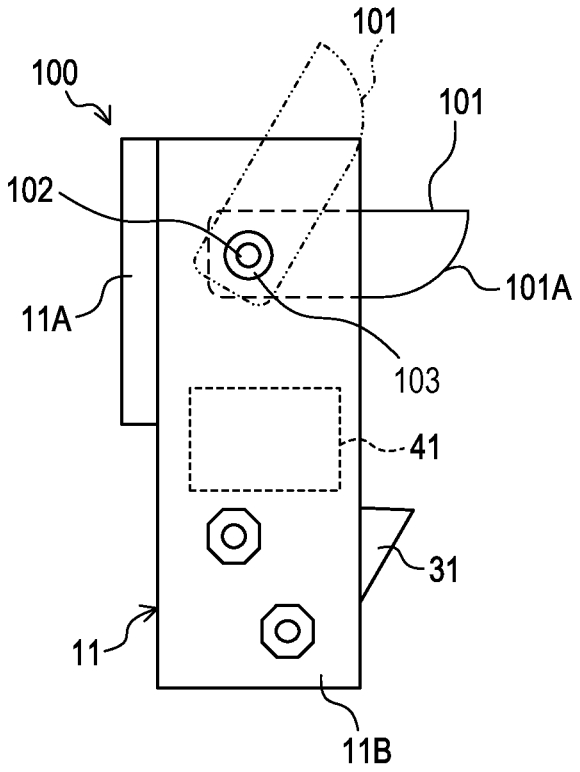
FIG. 6 is a left side view of a variation of the plate separator.

(2d) The aforementioned embodiment exemplifies a configuration in which the latch plate 22 is linearly moved along the horizontal direction. However, a moving direction of the latch plate is not especially limited. For example, the moving direction may be oblique. For example, as shown in a plate separator 100 shown in FIG. 6, a latch plate 101 may be configured to be rotatably moved about an axis 102. The latch plate 101 comprises a contact portion 101A and thus can function similarly to the plate separator 10. As a biasing portion to bias the latch plate 101, for example, a spiral spring 103 may be used.

(2e) Although the aforementioned embodiment exemplifies a configuration in which two latch plates 22 are provided in a single plate separator 10, a single latch plate 22, or, three or more latch plates 22 may be provided in a single plate separator 10.

(2f) The aforementioned embodiment exemplifies a configuration in which the two movable units 21 are disposed on both sides of the plurality of plates 2 as the center. However, the number and arrangement of the movable unit 21 may be arbitrarily adjusted according to the size, shape and the like of the plate 2. For example, the number of the movable unit 21 provided may be only one, or the movable units 21 may be disposed at locations where they do not face each other.

(2g) The aforementioned embodiment exemplifies a configuration in which the plate separator 10 comprises the magnetizing part 41. However, the plate separator 10 may not comprise the magnetizing part 41.

(2h) Functions of one constituent element in the aforementioned embodiment may be divided and separately performed by a plurality of constituent elements, or functions of a plurality of constituent elements may be integrated and performed by one constituent element. Part of the configuration in the aforementioned embodiment may be omitted. Addition, replacement, etc., of at least part of the configuration in the aforementioned embodiment may be carried out with respect to the configuration in the aforementioned other embodiment. It is to be noted that any modes included in the technical idea specified by the languages of the claims are embodiments of the present disclosure.

What is claimed is:

1. A plate conveyance system to move a top plate, which is a plate situated at a top of a plurality of plates stacked along an up-down direction, the plate conveyance system comprising:

a plate holder to lift the top plate upward to move the top plate to a specified position; and at least two plate separators, wherein the at least two plate separators each comprise:

two or more mobile parts configured to be movable between a first position and a second position, which is different from the first position, the two or more mobile parts being horizontally disposed side by side along a direction intersecting with a moving direction in which the two or more mobile parts are moved from the first position to the second position;

at least one biasing portion provided to each of the two or more mobile parts to bias the two or more mobile parts toward the first position, wherein the two or more mobile parts are disposed in one housing, wherein each of the two or more mobile parts comprises a contact portion, the contact portion being disposed on a lower face of the mobile part along a vertical direction and configured to come into contact with the top plate when the plate holder lifts the top plate upward, wherein each of the two or more mobile parts is further configured be moved toward the second position as being pushed by the top plate when the top plate in contact with the contact portion is moved further upward, thereby allowing an upward movement of the top plate, wherein the at least two plate separators comprise a first plate separator and a second plate separator disposed on both sides of the top plate, wherein the two or more mobile parts in the first plate separator and the two or more mobile parts in the second plate separator are arranged to face each other, and wherein a space between the two or more mobile parts in the first plate separator and the two or more mobile parts in the second plate separator is smaller than a width of the top plate.

2. The plate conveyance system according to claim 1, wherein the contact portion comprises a part protruding outward.

3. The plate conveyance system according to claim 1, further comprising a magnetizing part to magnetize the plurality of plates.

* * * * *